United States Patent [19]

Fromantin

[11] 4,030,154

[45] June 21, 1977

[54] MACHINE FOR PREFORMING SHOE UPPERS

[76] Inventor: Andre Paul Edouard Fromantin, 37, rue Caulaincourt, 75011 Paris, France

[22] Filed: Dec. 9, 1975

[21] Appl. No.: 639,188

[30] Foreign Application Priority Data

May 21, 1975 France ..... 75.15758

[52] U.S. Cl. ..... 12/54.1

[51] Int. Cl.[2] ..... A43D 11/00

[58] Field of Search ..... 12/54.1, 54.6, 53.2, 12/53.4, 53.5, 142 MC

[56] References Cited

UNITED STATES PATENTS

| | | | |
|---|---|---|---|
| 1,386,654 | 8/1921 | Pope | 12/142 MC |
| 2,301,785 | 11/1942 | Marx | 12/54.1 |
| 3,837,025 | 9/1974 | Lockwood et al. | 12/54.1 |

FOREIGN PATENTS OR APPLICATIONS

| | | | |
|---|---|---|---|
| 843,652 | 7/1939 | France | 12/54.1 |

*Primary Examiner*—Patrick D. Lawson
*Attorney, Agent, or Firm*—Ulle C. Linton

[57] ABSTRACT

Machine for preforming shoe uppers of the kind of those in which the periphery of the upper is squeezed between two surfaces during the action of a mold reproducing the profile of the last on which the shoe will be mounted, characterized in that the mold is articulated by one of its ends about an axis fixed in relation to the frame of the machine, and in that said mold can be displaced in a direction at right angles to the axis of rotation of the lever supporting it.

9 Claims, 13 Drawing Figures

9
8
6
3
2
4
7
16
10
12
22
17
19
16
11
P
18
20
$F_1$
1
21
III
III 2
3
14
13
15
16
10
11
12
23
22
17
P
18
19
20

MACHINE FOR PREFORMING SHOE UPPERS

The present invention relates to a machine for preforming shoe uppers.

The problem consists in laying flat on a mold, which substantially reproduces the top part of the last on which the shoe will be mounted, a piece of hide in such a way that the latter embraces the form of said mold which necessarily presents between its two ends a marked hollow especially if the shoe to be made must cover the entire part of the foot called "coup de pied" (the foot and ankle combined).

The existing machines are not satisfactory because they cannot, during the deformation, resist the formation of folds in the central portion of the upper corresponding to the top part of the foot.

The present invention, which remedies these disadvantages, is characterized in that the mold can pivot, relative to the frame of the machine, so as to apply the hide to be preformed against an elastically deformable composition.

According to another characteristic of the invention, the mold, which is carried by a pivoting lever, can be displaced, independently of the lever, in a direction at right angles to the axis of rotation of said lever.

The invention will be better understood by the description which follows, made with reference to the drawings annexed by way of indicative example only, in which.

Figure 1:
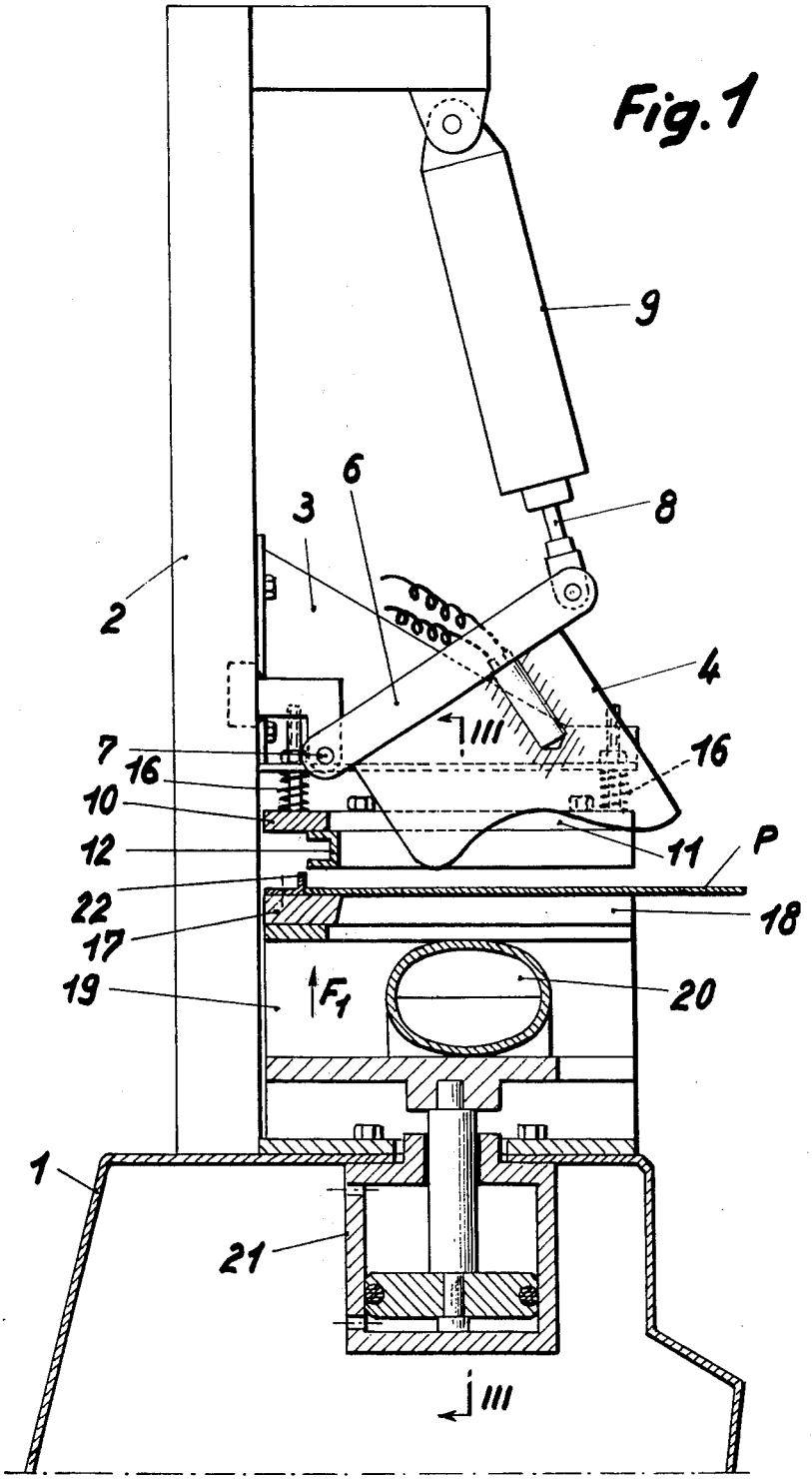
FIG. 1 is a view in vertical section of the machine.
Figure 2:
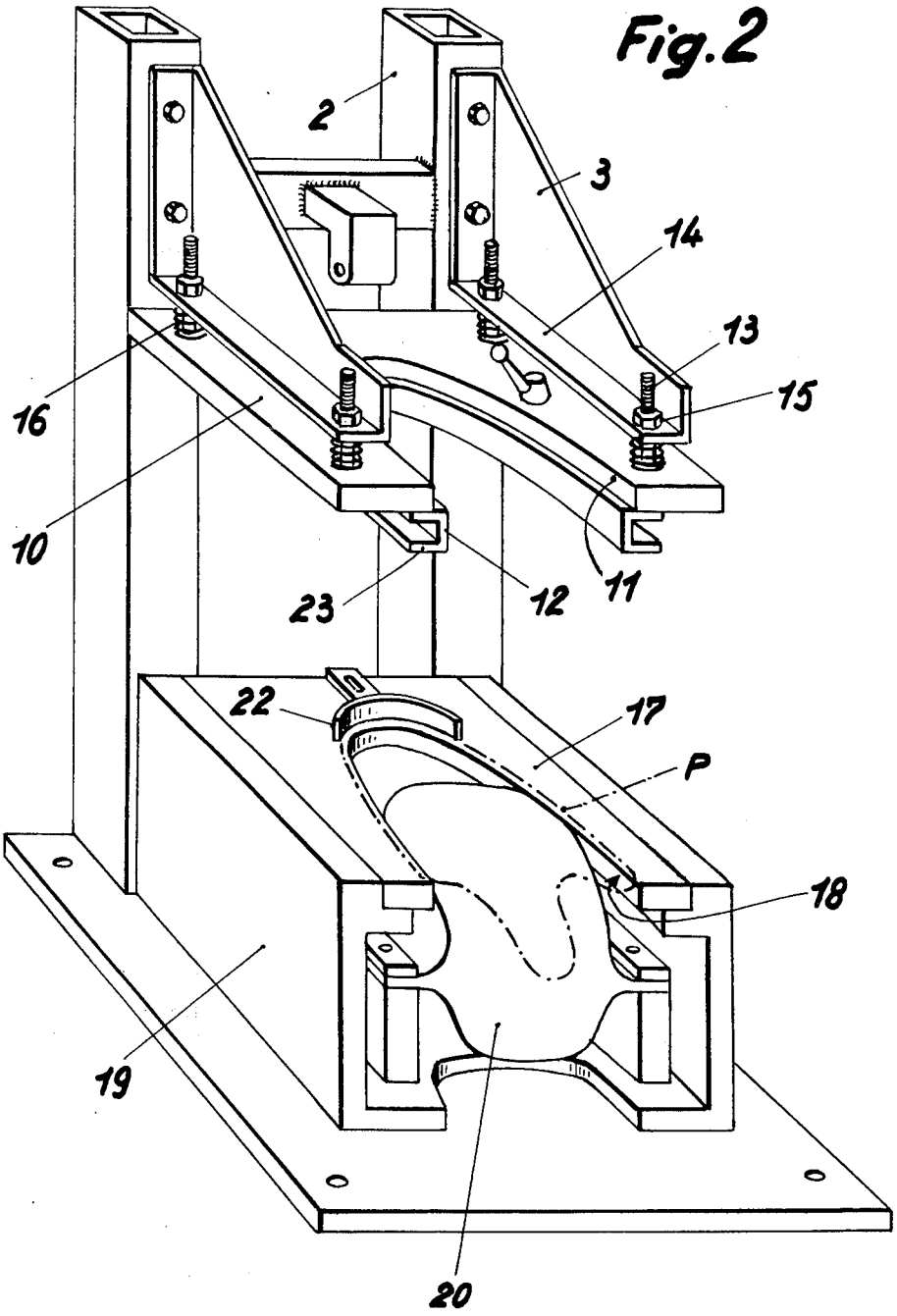
FIG. 2 is a view in perspective of the machine limited to its lower portion.
Figure 3:
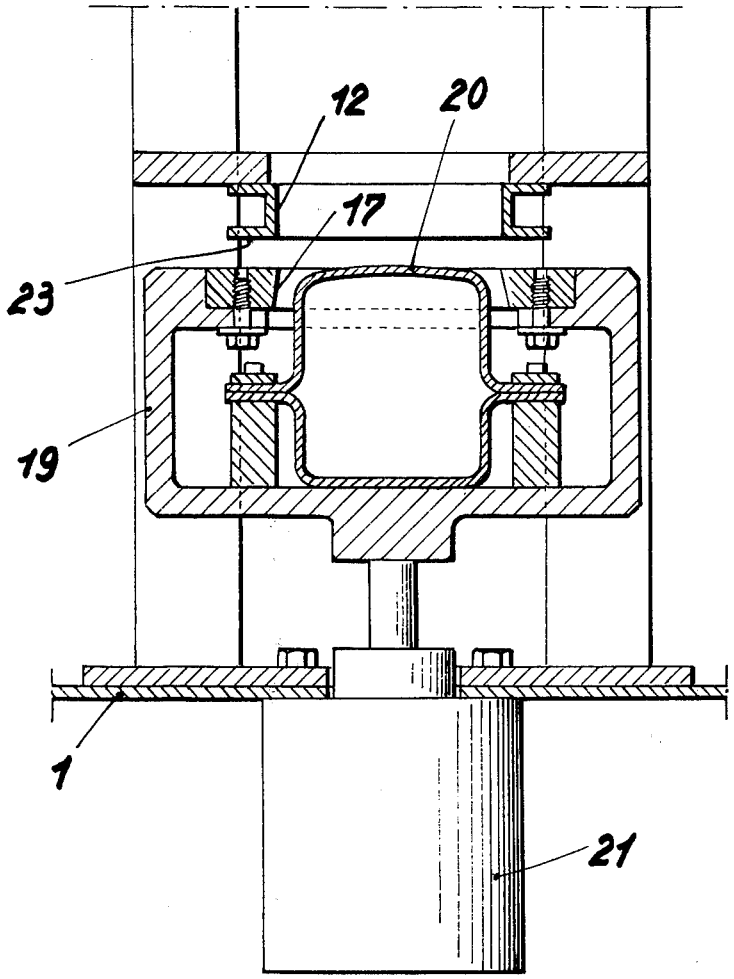
FIG. 3 is a view in section, on a larger scale, along line III—III of FIG. 1.

Referring to FIGS. 1 and 2, it is seen that the machine comprises a frame 1 provided with two columns 2 each supporting a bracket 3.

The columns 2 support the point of articulation of a mold 4, which may be heated.

Figure 4:
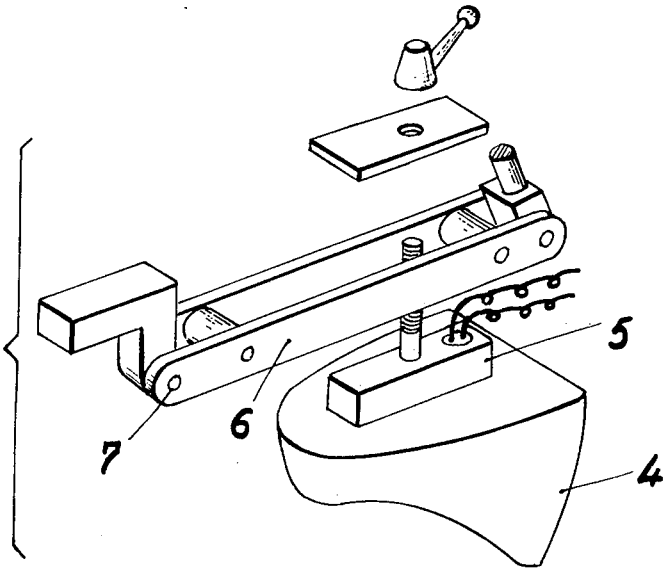
FIGS. 4 and 5 are partial views in exploded perspective showing details of construction.
Figure 5:
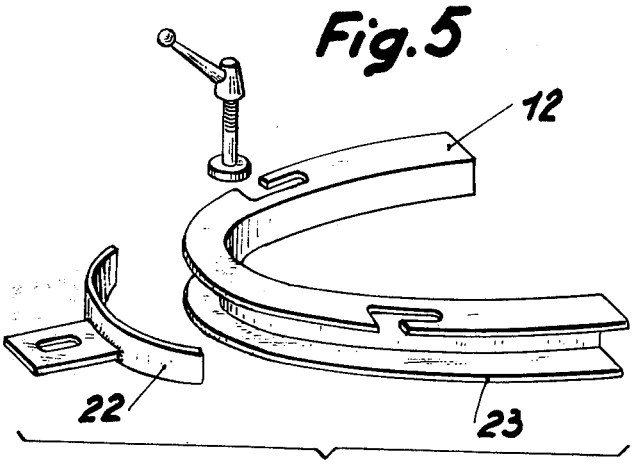
Figure 9:
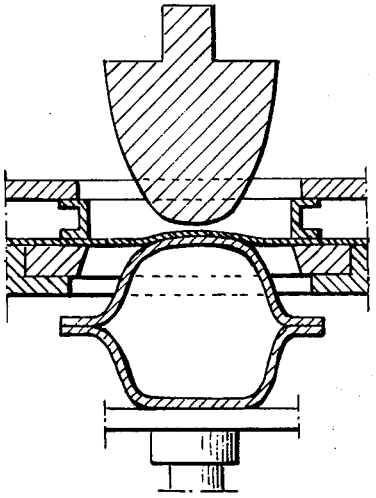
FIGS. 9, 10 and 11 are views in section taken respectively along lines IX—IX, X—X and XI—XI of FIGS. 6, 7 and 8.

According to one form of construction, the flat face of the mold 4 presents a strip 5 capable of being engaged and fixed in the hollowed central portion of a lever 6 articulated by one of its ends along a horizontal axis 7 (FIGS. 1 and 4).

The end of the mold 4 forming the tip of the shoe is directed toward the axis 7.

The free end of lever 6 is connected to the rod 8 of a jack 9 whose cylinder end is articulated between extensions of the columns 2.

Above the mold 4 is arranged a platform 10 presenting a passage which notch 11 of said mold, defined by a stirrup 12, the usefulness of which will become evident later on.

The platform 10 is supported by the brackets 3 of the columns, 2, and for this purpose it presents studs 13 traversing wings 14 of said brackets in order each to receive a nut 15.

The platform 10 is elastically urged downward under the action of springs 16, mounted on the studs 13 and interposed between said platform and the wings 14.

Below the platform 10 is disposed a plate 17 with a notch 18 analogous to notch 11.

Plate 17 forms the upper portion of a movable box 19, in the center of which is arranged an elastically deformable member 20 such as an inflatable rubber bag.

The box 19 will be displaced vertically under the action of a jack 21.

The operation of the machine is the following:

The hide P which is to form the upper is placed on the plate 17 so that its edges extend beyond those of the notch 18, the positioning of said upper being obtained by a stop 22, in stirrup form, fastened on said plate and against which the end of the upper takes support.

Figure 13:
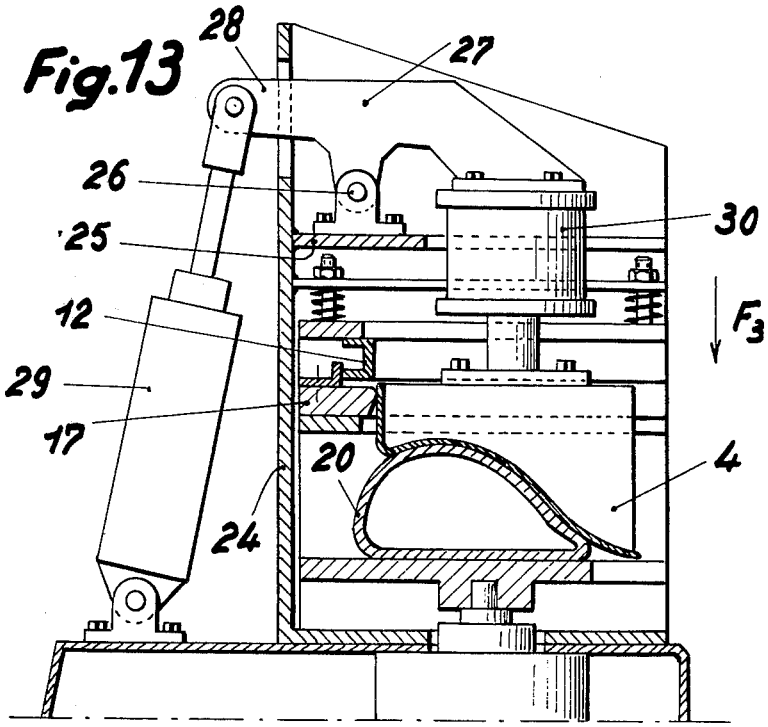
FIG. 13 is a view analogous to FIG. 12 showing the possibility of displacing the mold independently of the pivoting lever.

The box 19 is then raised in the direction of the arrow $F_1$ (FIG. 1) so as to lay the periphery of the upper flat under the platform 10. Strictly speaking, the periphery of the upper is squeezed between the plate 17 and a peripheral edge 23 of the stirrup 12 (FIG. 13).

Figure 6:
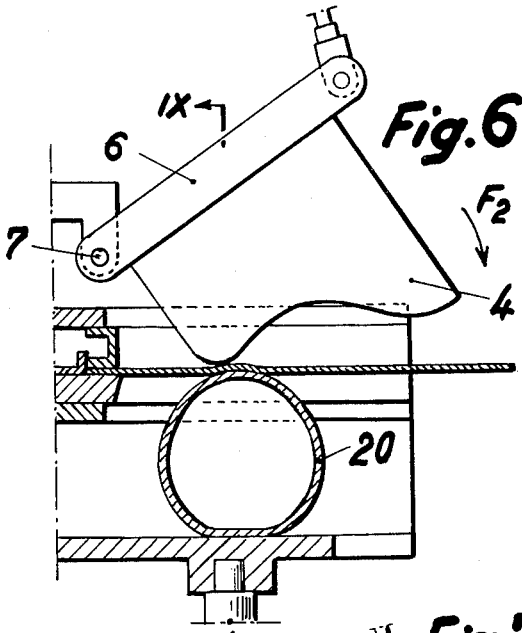
FIGS. 6, 7 and 8 are partial and schematic views showing, in several successive phases, the preforming of an upper.
Figure 10:
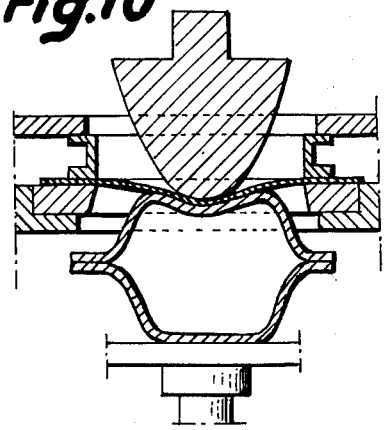
Figure 7:
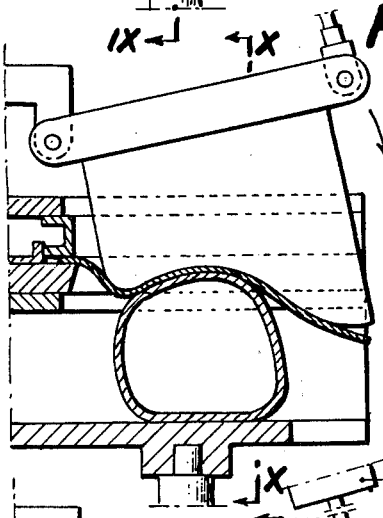

From that moment on, the bag 20 is inflated so as to bring it in contact with the central portion of the upper, and then, by actuating the jack 9, one lets the mold 4 pivot in the direction of arrow $F_2$ (FIGS. 6 and 7).

During the pivoting of the mold 4, the upper, squeezed between one end thereof and the bag, becomes deformed while perfectly embracing the profile of said mold.

Figure 11:
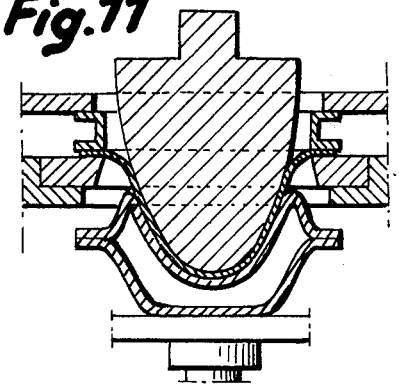
Figure 8:
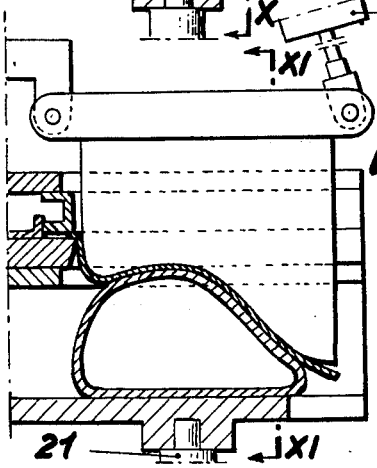

When the mold occupies the position shown in FIGS. 8 and 11, the bag is deflated and first jack 21 and then jack 9 are retracted.

The machine is then ready to carry out a new preforming.

It should be noted that, contrary to the existing machines comprising a mold and a counter-mold, the squeezing of the upper between the bag and the mold does not occur at first toward the center of the upper, that is, in the most hollow region of the mold, but from one of its ends. In this way, the hide constituting the upper cannot slip toward the most hollow portion of the mold and that is why the formation of folds is avoided.

Figure 12:
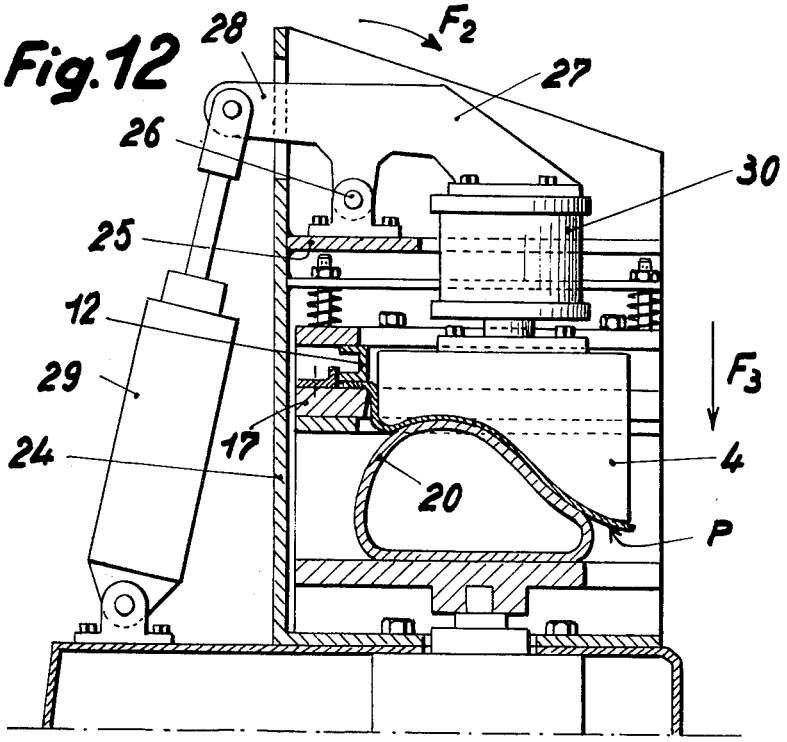
FIG. 12 is a view substantially analogous to FIG. 1 showing a variant of construction.

FIGS. 12 and 13 show a variant according to which the machine is composed of a frame 24 comprising a bracket 25 on which is articulated, through the agency of a shaft 26, a lever 27 which, by one of its ends 28, is connected to a jack 29 and, by the other, to the mold 4.

As already described herewith, the cut-out hide P constituting the upper is squeezed between the notched plate 17 and the stirrup 12.

By actuating the jack 29, one causes the lever 27 to pivot in the direction of the arrow $F_2$, conforming the upper which, under the action of the mold 4, is applied against the elastically deformable member 20.

If we consider FIG. 12, we see that lever 27 is in end-of-stroke position and that a portion of the periphery of the upper, near its tip, has remained squeezed between plate 17 and stirrup 12.

As the lever 27 cannot move, it is then necessary to displace the mold 4 in the direction of the arrow $F_3$ independently of said lever.

This result is obtained by interposing between the face end of lever 27 and the mold 4 a jack 30 whose body is fastened, for example, to said lever while its rod is integral with said mold.

From the position shown in FIG. 12, it then suffices to actuate the jack 30 to displace the mold 4 with the result of completely liberating the periphery of the upper from the hold of the squeezing device and laying it flat against the mold.

The present invention, of course, extends to all devices which, although structurally different would fulfill the same functions in respect of the same result.

I claim:

1. In a machine for preforming shoe uppers, in combination, a mold, a frame, a lever articulated on said frame and supporting said mold, a notched platform being supported under said mold, a notched plate being supported under said platform and on which the upper to be formed is to be positioned, a movable box supporting said plate, an elastically deformable member being positioned in the center of said box, means capable of pivoting said lever and causing said mold to pivot through the notches in said platform and said plate and means capable of displacing said box towards said plate.

2. In a machine for preforming shoe uppers as claimed in claim 1 in which the notches in said platform and said plate are identical and present a contour analogous to that of said mold.

3. In a machine for preforming shoe uppers as claimed in claim 1 wherein said platform is resiliently supported by springs to said frame and capable of being displaced upwards counter to the action of said springs upon upward displacement of said notched plate by the upward movement of said movable box.

4. In a machine for preforming shoe uppers as claimed in claim 1 wherein said mold is articulated only at one of its ends.

5. In a machine for preforming shoe uppers, in combination, a frame, a lever articulated on said frame and supporting a mold, a member interposed between said lever and said mold to displace the mold independently of said lever in a direction at right angles to the axis of rotation of said lever, a notched platform under said mold, a notched plate under said platform on which the upper rests, a movable box as support of said plate, an elastically deformable member in the center of said box, and means for causing said lever to pivot and for displacing said box.

6. Machine for preforming shoe uppers according to claim 5, in which a jack is interposed between the free end of the lever and the mold.

7. Machine for preforming shoe uppers according to claim 5, in which the notches provided on the platform and on the plate are identical and present a contour analogous to that of the mold.

8. Machine for preforming shoe uppers according to claim 5, in which the platform is elastically displaced upward counter to the action of springs under the effect of the likewise upward displacement of the plate supporting the upper.

9. Machine for preforming shoe uppers according to claim 5, in which the mold is articulated by one of its ends.

* * * * *